US006067924A

United States Patent [19]

Chatelain

[11] Patent Number: 6,067,924

[45] Date of Patent: May 30, 2000

[54] ANCHOR STOWAGE CONTAINER

[76] Inventor: Paul J. Chatelain, 16009 Amber Valley, Whittier, Calif. 90604

[21] Appl. No.: 09/126,281

[22] Filed: Jul. 30, 1998

[51] Int. Cl.[7] ..... B63B 17/00

[52] U.S. Cl. ..... 114/343; 114/210; 114/294; 114/364

[58] Field of Search ..... 114/294, 210, 114/343, 364

[56] References Cited

U.S. PATENT DOCUMENTS 3,106,181 10/1963 Dare ..... 114/210
3,143,993 8/1964 Salerno ..... 114/210
5,394,818 3/1995 Walker, II et al. ..... 114/294

*Primary Examiner*—Sherman Basinger
*Attorney, Agent, or Firm*—Edgar W. Averill, Jr.

[57] ABSTRACT

A container for supporting an anchor on its side on the deck of a boat. The container is a hollow enclosure having an enclosed bottom, sides and a top. The top of the hollow enclosure has an anchor support recess having two side recesses for the anchor flukes and a front recess for the anchor shank. The top has a central enclosure and as an anchor is raised, the line can be placed in the central enclosure and the anchor rested on the top with its flukes resting on the side support recesses and the shank resting in the front recess. A strap can be provided to hold the anchor on the container.

11 Claims, 1 Drawing Sheet

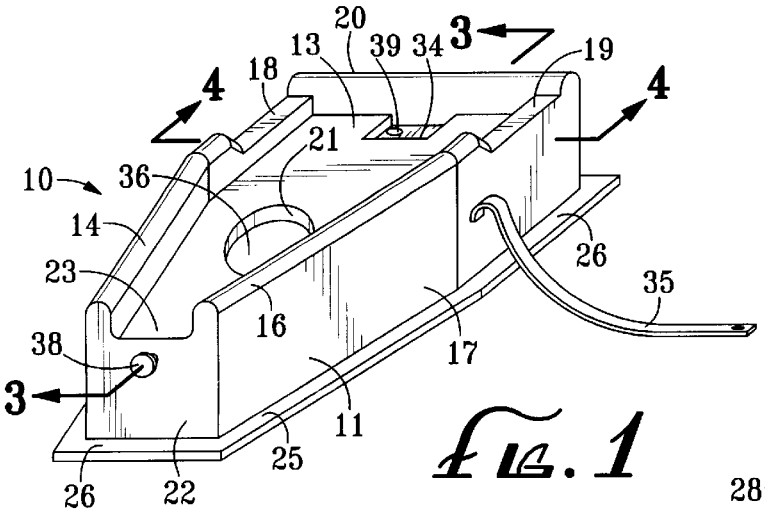
FIG. 1
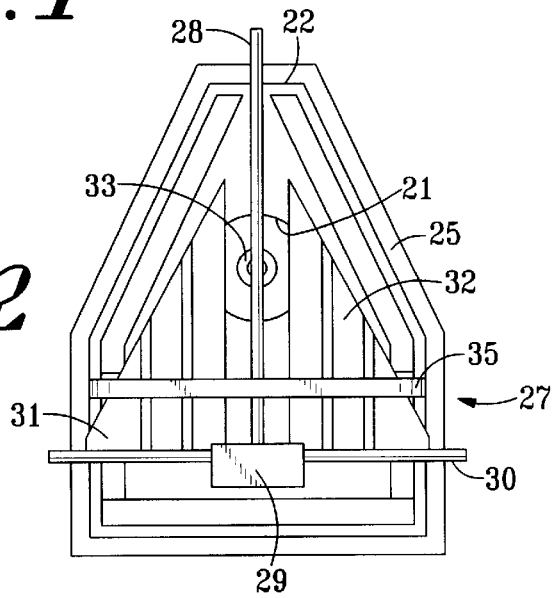
FIG. 2
FIG. 3
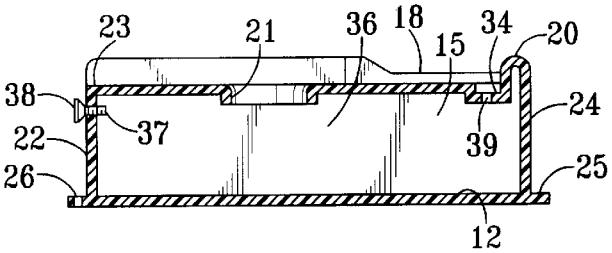
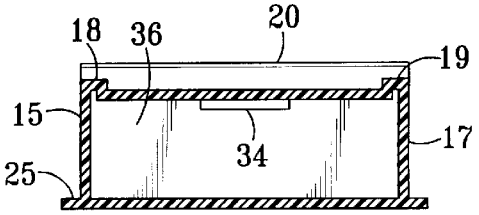
FIG. 4

ANCHOR STOWAGE CONTAINER

BACKGROUND OF THE INVENTION

The field of the invention is boating accessories and the invention relates more particularly to devices for supporting an anchor in a boat.

In smaller boats it is common to merely place the anchor on the deck of the boat so that it is ready for use. When the boat is put up the anchor is often placed in a bag together with the anchor line. The anchor and anchor line can be an inconvenience resting on the deck of a boat and a device for holding the anchor and anchor line helps eliminate a potential cleanup problem. This arises since the anchor is often dirty and when placed on the deck can soil the deck. Furthermore, the anchor usually has a short length of chain attached to a shackle at the end of the anchor shank. This chain can rust slightly and can also soil the deck.

U.S. Pat. No. 5,394,818 shows an anchor stowage apparatus which stows an anchor so that its flukes and shank are approximately vertical. Because of this the device must be secured to the boat since the anchor would otherwise be unstable in this vertical position.

BRIEF SUMMARY OF THE INVENTION

It is an object of the present invention to provide a container for stowing an anchor on the deck of a boat.

The present invention is for a container for supporting an anchor on its side on the deck of a boat. The container has a hollow enclosure with a closed bottom, sides and top. The top of the enclosure has an anchor support recess which has two side recesses and a front recess. It also has an opening in the top for the placement of an anchor line. Preferably, the top also has a recess for the crown of an anchor. The device also may have a strap for securing the anchor thereto and a flange for securing the container to a deck.

BRIEF DESCRIPTION OF THE DRAWINGS

FIG. 1 is a perspective view showing the top, front and right side of the anchor stowage container of the present invention.

FIG. 2 is a top view thereof, including an anchor.

FIG. 3 is a cross-sectional view taken along line 3—3 of FIG. 1.

FIG. 4 is a cross-sectional view taken along line 4—4 of FIG. 1.

DESCRIPTION OF THE PREFERRED EMBODIMENTS

The anchor stowage container 10 is shown in perspective view in FIG. 1. Container 10 is basically a hollow enclosure 11 with a closed bottom 12 shown best in FIG. 3 and 4. The top 13 has a raised peripheral ridge 14 along its left side 15. Similarly, it has a raised peripheral ridge 16 along its right side 17. Ridge 14 has a left side fluke recess 18 and ridge 16 has a right side fluke recess 19. A raised back ridge 20 is at the back of top 13. Preferably, fluke recesses 18 and 19 are raised above top 13 so that any water dripping off of the anchor will find its way into a central opening 21. At the front 22 of the enclosure there is a shank recess 23. The back of the container is indicated by reference character 24 and a flange 25 extends around the entire periphery of container 10. Flange 25 preferably has a plurality of openings 26 which permit the owner to secure container 10 to the deck of the boat.

Container 10 is shown in FIG. 2 holding an anchor 27. Anchor 27 has a shank 28 which terminates in a crown 29. A stock 30 extends both directions from the crown and supports a first fluke 31 and a second fluke 32. Anchor 27 is a "Danforth" style of anchor which carries a ring 33 on the shank which is an elongated U-shaped shank. A recess 34 is formed below top 13 adjacent back 24. This crown recess helps to permit the flukes of the anchor to rest close to top 13. A strap 35 may be provided which may be snapped or otherwise attached to the right and left sides over the anchor as shown in FIG. 2 to hold the anchor in place. Smaller anchors may also be held on container 10 where the flukes would rest in top 13.

Opening 21 is sufficiently large so that the anchor line may be placed into the interior 36. An opening 37 may be closed with a plug 38 to permit the water inside of interior 36 to be drained when desired. A drain hole 39 may be provided in recess 34 to keep the recess 34 from filling up with water. Of course, it is also contemplated that openings will be made by those who wish the interior 36 to be self-draining.

The container is preferably fabricated from a polymeric material having excellent weather resistance and strength, such as ABS. The wall thickness should be sufficient to provide impact resistance in the event an anchor is thrown onto the top. A ⅛" wall thickness has been found satisfactory. The container may be fabricated utilizing vacuum forming where the bottom and the sides are formed into two different pieces and bonded together. Alternatively, it may be rotationally cast or blow molded, either one of which permits an economical fabrication method.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A container for supporting an anchor on its side on the deck of a boat comprising:

a hollow enclosure having a closed bottom, sides and a top, said top of said hollow enclosure having an anchor support recess having two side recesses and a front recess and said top having an opening for placement of an anchor line therethrough.

2. The container for supporting an anchor of claim 1 wherein said top of said hollow enclosure also includes a recess for holding a crown of an anchor placed thereon.

3. The container for supporting an anchor of claim 1 wherein said top is closed except for a centrally located opening for inserting anchor line into said hollow enclosure.

4. The container for supporting an anchor of claim 1 further including an anchor securing strap attachable to one of said sides and including means for attaching said anchor securing strap to an opposite side of said hollow enclosure.

5. A container supporting an anchor of the type having a first and second flukes, a crown, a stock and a shank comprising:

a container portion having a bottom, a back side, a right side, a left side and a front, a top having a raised peripheral ridge, said raised peripheral ridge having a right side fluke recess, a left side fluke recess, a shank recess above said front and a crown recess adjacent said back; and an anchor resting on the top of said container portion with its first fluke resting on said right side fluke recess, its second fluke resting on said left side recess, its shank resting in said shank recess and its crown resting in said crown recess.

6. The container supporting an anchor of claim 5 wherein said top further has an opening into which line attached to said anchor extends into so that the line attached to said anchor is held within said container.

7. The container supporting an anchor of claim 5 wherein said container portion also has a flange extending outwardly from the bottom past the sides.

8. The container supporting an anchor of claim 5 further including a closable water drain opening and a drain closure.

9. The container supporting an anchor of claim 5 further including a strap to hold said anchor on said container.

10. The container supporting an anchor of claim 9 wherein said strap has a first and a second end and the first end is affixed to the right side and the second end is affixed to the left side.

11. The container supporting an anchor of claim 5 further including a flange extending outwardly from the bottom with a plurality of holes therethrough for securing the container to a boat deck.

* * * * *